US010312572B2

(12) United States Patent
Chen

(10) Patent No.: US 10,312,572 B2
(45) Date of Patent: Jun. 4, 2019

(54) MINIATURIZED MULTI-BAND ANTENNA

(71) Applicant: HON HAI PRECISION INDUSTRY CO., LTD., New Taipei (TW)

(72) Inventor: Wei-Yu Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/713,808

(22) Filed: Sep. 25, 2017

(65) Prior Publication Data

US 2018/0191057 A1 Jul. 5, 2018

(30) Foreign Application Priority Data

Dec. 30, 2016 (CN) ..... 2016 1 1262376

(51) Int. Cl.

| | |
|---|---|
| ***H01Q 1/24*** | (2006.01) |
| ***H01Q 1/38*** | (2006.01) |
| ***H01Q 5/371*** | (2015.01) |
| ***H01Q 21/30*** | (2006.01) |
| ***H01Q 5/378*** | (2015.01) |
| ***H01Q 9/42*** | (2006.01) |

(52) U.S. Cl.

CPC ..... *H01Q 1/243* (2013.01); *H01Q 1/38* (2013.01); *H01Q 5/371* (2015.01); *H01Q 5/378* (2015.01); *H01Q 9/42* (2013.01); *H01Q 21/30* (2013.01)

(58) Field of Classification Search

CPC ..... H01Q 1/243; H01Q 5/371; H01Q 5/378; H01Q 9/42; H01Q 21/30

See application file for complete search history.

(56) References Cited

U.S. PATENT DOCUMENTS

2014/0062796 A1* 3/2014 Chen ..... H01Q 1/243 343/700 MS

2014/0361948 A1* 12/2014 Tanaka ..... H01Q 1/38 343/861

* cited by examiner

*Primary Examiner* — Hoang V Nguyen

(74) *Attorney, Agent, or Firm* — ScienBiziP, P.C.

(57) ABSTRACT

A miniaturized antenna providing multiband functionality includes a ground portion, a feeder, a first radiator, and a second radiator. The ground portion is grounded. The feeder has a feed end. The feed end can transmit and receive radio frequency (RF) signals. The first radiator is connected to the ground portion. The first radiator and the feeder are spaced apart from each other by a gap. The gap can cause a coupling between the first radiator and the feeder to transmit the RF signal. The second radiator is connected to the first radiator. The second radiator can transmit the RF signal from the first radiator. Multi-band operation is obtained and size of antenna is reduced.

17 Claims, 5 Drawing Sheets

MINIATURIZED MULTI-BAND ANTENNA

CROSS REFERENCE TO RELATED APPLICATION

This application claims priority to Chinese Patent Application No. 201611262376.5, filed Dec. 30, 2016, the disclosure of which is incorporated herein by reference in its entirety.

FIELD

The present disclosure relates to wireless communication, and more particularly to a miniaturized multi-band antenna.

BACKGROUND

A conventional method for transmitting and receiving radio frequency (RF) signals in different frequency bands is to use a plurality of separate antennas. However, the plurality of separate antennas is large and thus does not allow for miniaturization of antennas.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
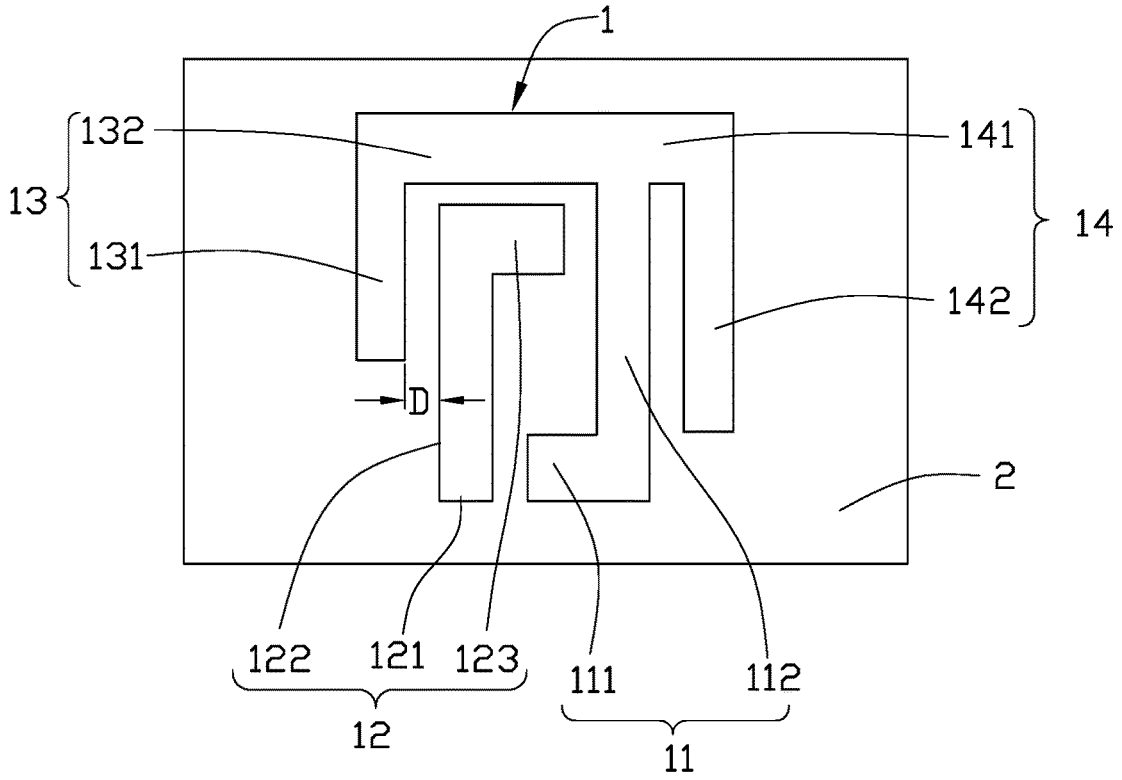
FIG. 1 is a schematic view of a multi-band antenna on a substrate.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

Figure 2:
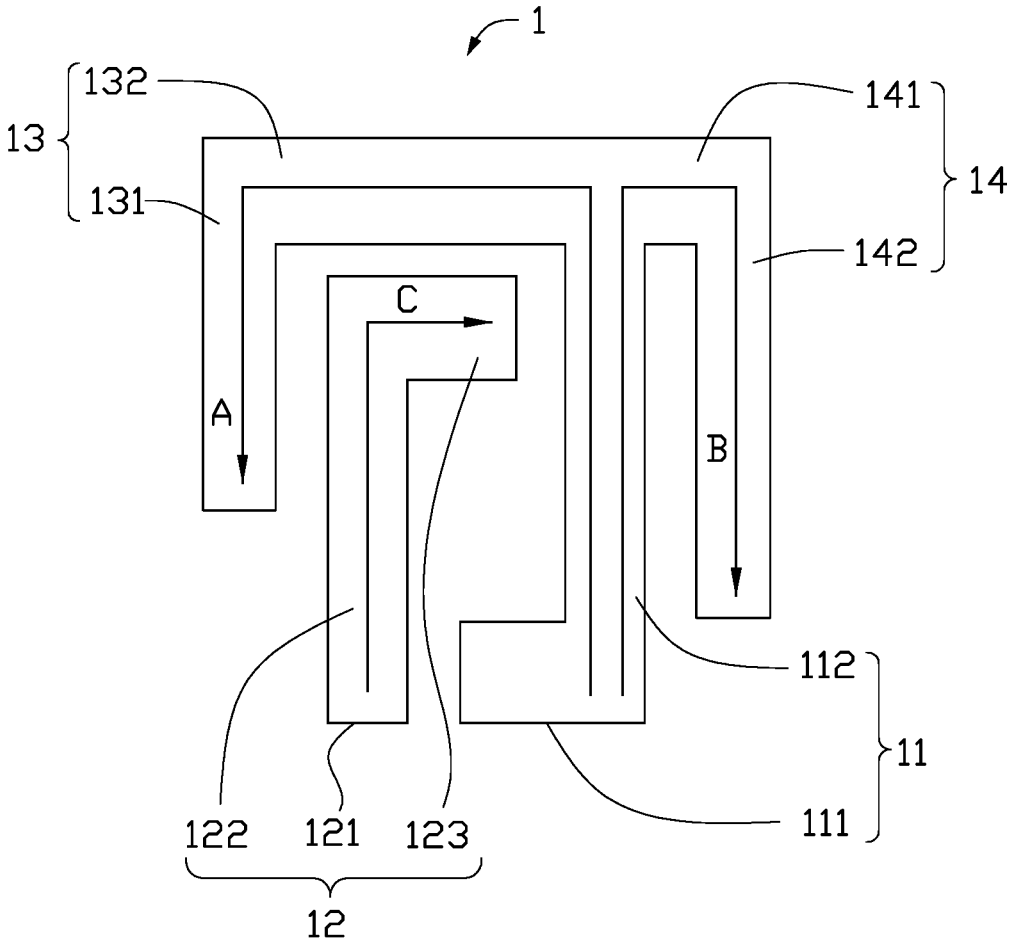
FIG. 2 is an enlarged view of the multi-band antenna of FIG. 1, showing signal paths in three different frequency bands.

With reference to FIGS. 1 and 2, an exemplary embodiment of a multi-band antenna shows antenna 1 mounted on a substrate 2. The substrate 2 may be insulating. The multi-band antenna 1 includes a ground portion 11, a feeder 12, a first radiator 13, and a second radiator 14. The ground portion 11, the feeder 12, the first radiator 13, and the second radiator 14 are coplanar.

In the present exemplary embodiment, the ground portion 11 is elongated, and is grounded. The ground portion 11 is a metal sheet. The ground portion 11 is L-shaped, and has a ground arm 111 and a connecting arm 112. The ground arm 111 and the connecting arm 112 are perpendicular to each other. The ground portion 11 may be copper foil.

The feeder 12 is elongated, and has a feed end 121. The feed end 121 can transmit and receive RF signals.

In the present exemplary embodiment, the feeder 12 is single-polarized. The feeder 12 is L-shaped, and has a first feed arm 122 and a second feed arm 123. The first feed arm 122 and the second feed arm 123 are perpendicular to each other. The feed end 121 is located at an end of the first feed arm 122 away from the second feed arm 123.

The ground portion 11 and the feeder 12 are spaced from each other to generally form the shape of an open rectangular frame. The ground arm 111 of the ground portion 11 is parallel to the second feed arm 123 of the feeder 12. The connecting arm 112 of the ground portion 11 is parallel to the first feed arm 122 of the feeder 12. A gap (unlabeled) is formed between the second feed arm 123 and the connecting arm 112 and another gap (unlabeled) is formed between the ground arm 111 and first feed arm 122, thus the rectangular frame being called open.

The first radiator 13 is elongated, and is connected to the ground portion 11. The first radiator 13 and the feeder 12 are spaced from and not connected to each other. A gap D is formed between the first radiator 13 and the feeder 12. The gap D can cause a coupling between the first radiator 13 and the feeder 12 to transmit the RF signal.

The second radiator 14 is elongated, and is connected to the ground portion 11 and the first radiator 13. The second radiator 14 can transmit the RF signal from the first radiator 13.

In the present exemplary embodiment, the first radiator 13 is L-shaped, and has a first metal arm 131 and a second metal arm 132. The first metal arm 131 and the second metal arm 132 are perpendicular to each other. The first metal arm 131 is parallel to the first feed arm 122 of the feeder 12 to form the gap D. The gap D is less than or equal to 5 mm. The second metal arm 132 is connected between the first metal arm 131 and the connecting arm 112 of the ground portion 11. The second metal arm 132 is parallel to the second feed arm 123 of the feeder 12. The second radiator 14 is L-shaped, and has a third metal arm 141 and a fourth metal arm 142. The third metal arm 141 and the fourth metal arm 142 are perpendicular to each other. The third metal arm 141 is connected between the fourth metal arm 142 and the connecting arm 112 of the ground portion 11. An end of the third metal arm 141 connected to the connecting arm 112 and an end of the second metal arm 132 connected to the connecting arm 112 are connected to each other. The fourth metal arm 142 is parallel to the connecting arm 112 of the ground portion 11.

When the multi-band antenna 1 is in use, the feeder 12 receives an RF signal through the feed end 121, the first radiator 13 then transmits the RF signal through the coupling between the first radiator 13 and the feeder 12. The second radiator 14 then transmits the RF signal through the first radiator 13 connected to the second radiator 14. The RF signals in three different frequency bands can be fed to the feeder 12 along three signal paths. The first signal path sequentially passes through the connecting arm 112, the second metal arm 132, and the first metal section 131

(Arrow A of FIG. 2). The second signal path sequentially passes through the connecting arm 112, the third metal arm 141, and the fourth metal arm 142 (Arrow B of FIG. 2). The third signal path sequentially passes through the first feed arm 122 and the second feed arm 123 (Arrow C of FIG. 2).

The signal paths in different frequency bands are resonantly formed depending on the length of the feeder 12, the length of the first radiator 13, the length of the second radiator 14, the length of the connecting arm 112, and the width of the gap D. The length of the first radiator 13 is less than one-quarter of the wavelength of the RF signal in a first frequency band. The length of the second radiator 14 is less than one-quarter of the wavelength of the RF signal in a second frequency band. The length of the feeder 12 is less than one-quarter of the wavelength of the RF signal in a third frequency band. Therefore, multi-band operation can be achieved together with size reduction of the multi-band antenna 1. In the present exemplary embodiment, the first frequency band is between approximately 1575 MHz and 1900 MHz to transmit and receive GPS signals. The second frequency band is between approximately 2400 MHz and 2480 MHz to transmit and receive 2.4 GHz Wi-Fi signals. The third frequency band is between approximately 5000 MHz and 5800 MHz to transmit and receive 5 GHz Wi-Fi signals.

Figure 3:
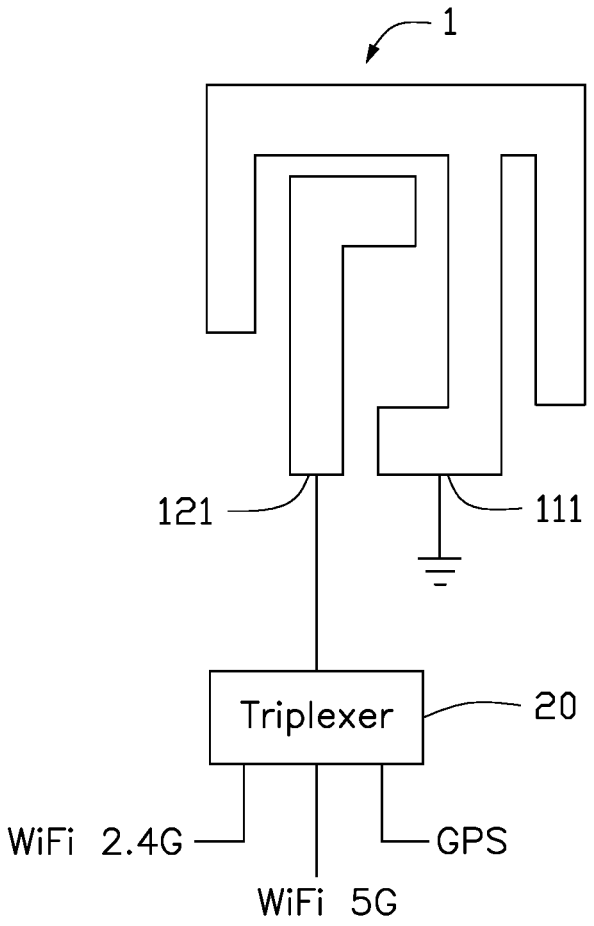
FIG. 3 is a schematic view of the multi-band antenna of FIG. 1 connected to a triplexer.
Figure 4:
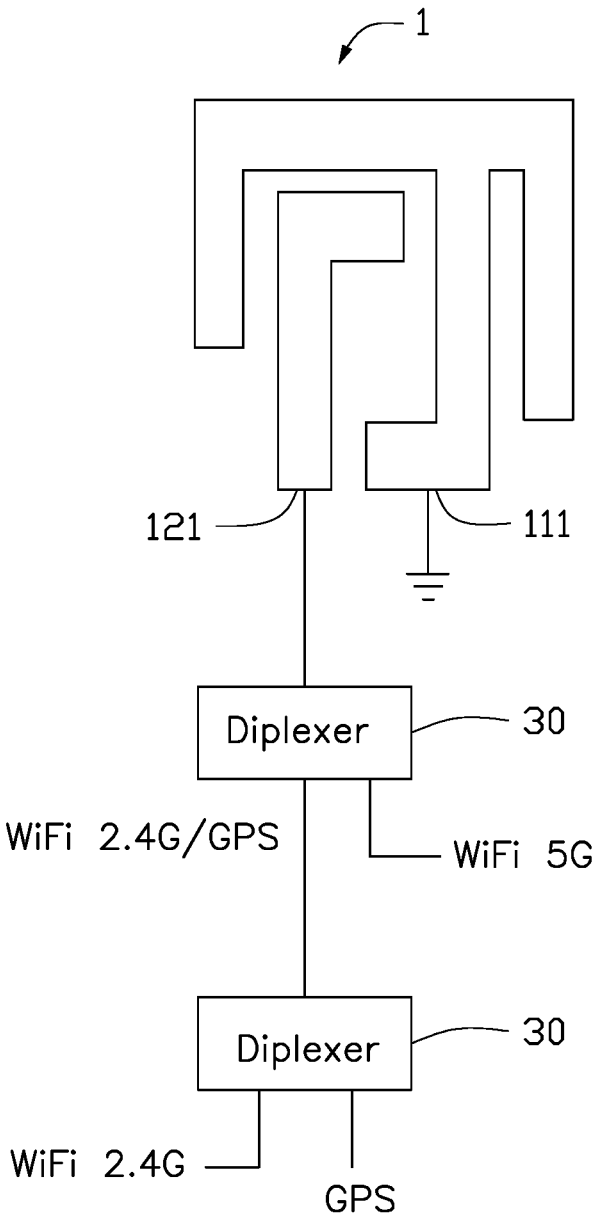
FIG. 4 is a schematic view of the multi-band antenna of FIG. 1 connected to two duplexers.

With reference to FIG. 3, the multi-band antenna 1 may be connected to a triplexer 20 through the feed end 121 for separating the GPS signals, the 2.4 GHz Wi-Fi signals, and the 5 GHz Wi-Fi signals. With reference to FIG. 4, the multi-band antenna 1 may be connected to two series-connected duplexers 30 through the feed end 121. One duplexer 30 separates the 2.4 GHz Wi-Fi/GPS signals and the 5 GHz Wi-Fi signals, and the other duplexer 30 separates the 2.4 GHz Wi-Fi signals and the GPS signals.

Figure 5:
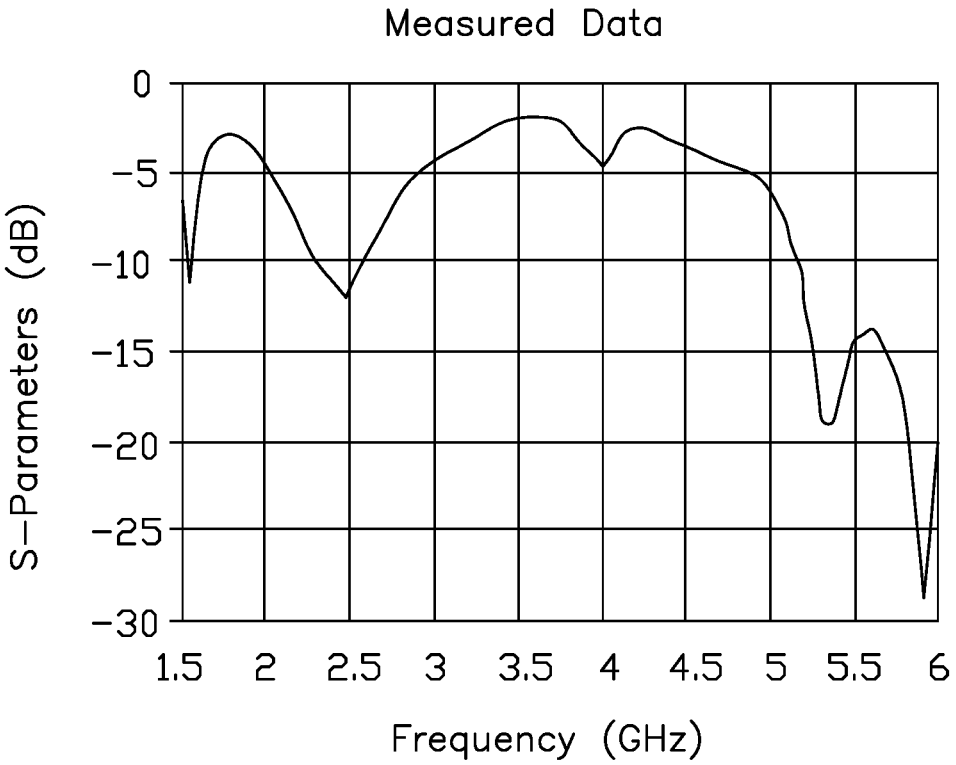
FIG. 5 is a voltage standing wave ratio diagram of the multi-band antenna of FIG. 1.

With reference to FIG. 5, a voltage standing wave ratio diagram of the multi-band antenna 1 is illustrated. The multi-band antenna 1 can transmit and receive the RF signals in the first frequency band, the second frequency band, and the third frequency band.

The multi-band antenna 1 can transmit and receive the RF signals in other frequency bands by changing the length of the feeder 12, the length of the first radiator 13, the length of the second radiator 14, and the width of the gap D.

The exemplary embodiments shown and described above are only examples. Many details are often found in the art such as the other features of an antenna. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. A multi-band antenna comprising:

a ground portion;

a feeder having a feed end;

a first radiator connected to the ground portion; and a second radiator connected to the first radiator;

wherein the first radiator and the feeder are spaced apart from each other by a gap;

wherein the ground portion and the feeder are spaced from each other to generally form the shape of an open rectangular frame;

wherein the ground portion has a ground arm and a connecting arm, and the ground arm and the connecting arm are perpendicular to each other;

wherein the feeder has a first feed arm and a second feed arm, the first feed arm and the second feed arm are perpendicular to each other;

wherein the ground arm of the ground portion is parallel to the second feed arm of the feeder, and the connecting arm of the ground portion is parallel to the first feed arm of the feeder; and wherein the feed end of the feeder is located at an end of the first feed arm away from the second feed arm.

2. The multi-band antenna of claim 1, wherein the first radiator has a first metal arm and a second metal arm, the first metal arm and the second metal arm are perpendicular to each other, the first metal arm is parallel to the first feed arm of the feeder to form the gap, the second metal arm is connected between the first metal arm and the connecting arm of the ground portion, and the second metal arm is parallel to the second feed arm of the feeder.

3. The multi-band antenna of claim 2, wherein the gap is less than or equal to 5 mm.

4. The multi-band antenna of claim 2, wherein the second radiator has a third metal arm and a fourth metal arm, the third metal arm and the fourth metal arm are perpendicular to each other, the third metal arm is connected between the fourth metal arm and the connecting arm of the ground portion, an end of the third metal arm connected to the connecting arm and an end of the second metal arm connected to the connecting arm are connected to each other, and the fourth metal arm is parallel to the connecting arm of the ground portion.

5. The multi-band antenna of claim 2, wherein the first radiator has a length less than one-quarter of a wavelength of a signal in a first frequency band.

6. The multi-band antenna of claim 5, wherein the second radiator has a length less than one-quarter of a wavelength of a signal in a second frequency band.

7. The multi-band antenna of claim 5, wherein the feeder has a length less than one-quarter of a wavelength of a signal in a third frequency band.

8. The multi-band antenna of claim 1, wherein the first radiator has a length less than one-quarter of a wavelength of a signal in a first frequency band.

9. The multi-band antenna of claim 8, wherein the second radiator has a length less than one-quarter of a wavelength of a signal in a second frequency band.

10. The multi-band antenna of claim 9, wherein the feeder has a length less than one-quarter of a wavelength of a signal in a third frequency band.

11. The multi-band antenna of claim 10, wherein the first frequency band is between 1575 MHz and 1900 MHz, the second frequency band is between 2400 MHz and 2480 MHz, and the third frequency band is between 5000 MHz and 5800 MHz.

12. The multi-band antenna of claim 8, wherein the feeder has a length less than one-quarter of a wavelength of a signal in a third frequency band.

13. The multi-band antenna of claim 1, wherein the second radiator has a length less than one-quarter of a wavelength of a signal in a second frequency band.

14. The multi-band antenna of claim 13, wherein the feeder has a length less than one-quarter of a wavelength of a signal in a third frequency band.

15. The multi-band antenna of claim 1, wherein the feeder has a length less than one-quarter of a wavelength of a signal in a third frequency band.

16. The multi-band antenna of claim 1, wherein the multi-band antenna comprises at least a three band antenna for use in a first frequency band of 1575 MHz to 1900 MHz, a second frequency band of 2400 MHz to 2480 MHz, and a third frequency band of 5000 MHz to 5800 MHz.

17. The multi-band antenna of claim 1, wherein the multi-band antenna can be used in a first frequency band of 1575 MHz to 1900 MHz, a second frequency band of 2400 MHz to 2480 MHz, or a third frequency band of 5000 MHz to 5800 MHz.

* * * * *